US007458791B2

(12) United States Patent
Radziwill

(10) Patent No.: US 7,458,791 B2
(45) Date of Patent: Dec. 2, 2008

(54) ROTARY WORKING MACHINE PROVIDED WITH AN ASSEMBLY OF WORKING CHAMBERS WITH PERIODICALLY VARIABLE VOLUME, IN PARTICULAR A COMPRESSOR

(75) Inventor: Maciej Radziwill, Warsaw (PL)

(73) Assignee: Radziwill Compressors SP. Z O.O., Rytwiany (PL)

( * ) Notice: Subject to any disclaimer, the term of this patent is extended or adjusted under 35 U.S.C. 154(b) by 189 days.

(21) Appl. No.: 10/592,455

(22) PCT Filed: Mar. 8, 2005

(86) PCT No.: PCT/PL2005/000014

§ 371 (c)(1),
(2), (4) Date: Sep. 7, 2006

(87) PCT Pub. No.: WO2005/085598

PCT Pub. Date: Sep. 15, 2005

(65) Prior Publication Data

US 2007/0201998 A1 Aug. 30, 2007

(30) Foreign Application Priority Data

Mar. 9, 2004 (EP) ..... 04460001

(51) Int. Cl.
*F01C 21/00* (2006.01)

(52) U.S. Cl. ..... 418/150; 418/225

(58) Field of Classification Search ..... 418/150, 418/220, 225; 29/888.02

See application file for complete search history.

(56) References Cited

U.S. PATENT DOCUMENTS

RE19,772 E * 12/1935 Dudley ..... 418/139

(Continued)

FOREIGN PATENT DOCUMENTS

DE 622 554 11/1935

(Continued)

OTHER PUBLICATIONS

PCT Search Report From WIPO regarding priority PCT/PL2005/000014 dated Jun. 27, 2005.

*Primary Examiner*—Mary A Davis
(74) *Attorney, Agent, or Firm*—Brinks Hofer Gilson & Lione

(57) ABSTRACT

Rotary working machine provided with an assembly of working chambers with periodically variable volume, in particular a compressor, consisting of a stator with a controlling cam and a surrounding cylindrical rotator, with which are connected working elements, rotating together with it, driven by the cam and forming, together with an inner surface of the rotator and an outer surface of the cam, working chambers with variable volume, connected during the rotator's rotation with an intake and an outlet, respectively, of a medium being compressed. The compressor is characterized in that the assembly of working elements (10, 11, 12), forming a working unit (9) or separate working elements (10'), are connected with the cylindrical rotator (8, 8') in a way enabling 6 their oscillating motion. Points (23, 23') of contact of the working elements (10, 11, 12, 10') are simultaneously driven by the cam (5, 6, 7, 5'), the outline of which constitutes a line equidistant from a Radziwill curve, constituting a locus of points forming a closed trajectory being described, on an immobile plane perpendicular to the axis of the cylindrical rotator (8, 8'), by a vertex point (C, C') of the working element (10, 11, 12, 10'), moving in relation to the rotator (8, 8') in an oscillation with a resonance frequency during one full revolution of the cylindrical rotator (8, 8'). Inertia moment lo, of the working unit (9), or the working element (10'), has a value ensuring the resonance frequency of proper vibration of the working unit (9), or the working element (10'), wherein a ratio of the resonance oscillation frequency to a frequency of the cylindrical rotator's (8, 8') revolution is expressed by a natural number v.

13 Claims, 11 Drawing Sheets

U.S. PATENT DOCUMENTS

| | | | | | |
|---|---|---|---|---|---|
| 2,719,513 | A | * | 10/1955 | Dezell | 418/150 |
| 3,260,248 | A | * | 7/1966 | Lyle | 123/232 |
| 3,387,596 | A | | 6/1968 | Niemand | |
| 3,426,694 | A | * | 2/1969 | Marsh | 418/186 |
| 5,379,736 | A | | 1/1995 | Anderson | |

FOREIGN PATENT DOCUMENTS

| | | |
|---|---|---|
| DE | 898 697 | 12/1953 |
| DE | 1 551 101 | 5/1967 |
| WO | WO/0042290 | 7/2000 |

* cited by examiner

ROTARY WORKING MACHINE PROVIDED WITH AN ASSEMBLY OF WORKING CHAMBERS WITH PERIODICALLY VARIABLE VOLUME, IN PARTICULAR A COMPRESSOR

This application is a United States national phase application of international application No. PCT/PL2005/000014, filed on March 8, 2005 that claims priority to European Application No. 04460001.3, filed on March 9, 2004, which are both incorporated by reference in their entirety herein.

This invention relates to a rotary working machine provided with an assembly of working chambers with periodically variable volume, in particular a compressor, consisting of a stator with a controlling cam and of a surrounding cylindrical rotator, with which are connected working elements, rotating with the rotator, driven by the cam and forming, together with an inner surface of the rotator and an outer surface of the cam, working chambers with periodically variable volume, connected with an intake and an outlet of a medium being compressed.

Since 1908 is known a blade-type working machine, employed particularly as a compressor, consisting of a rotor, eccentrically supported inside a stationary block and of a set of blades, slidable in grooves of the rotor. Rotation of the rotor causes the blades moving in and out, which are controlled by an inner surface of the cylindrical block, thus permitting formation of working chambers with periodically variable volume, enabling intake and compression of a medium.

A disadvantage of the blade-type working machines is in energy losses due to a friction of the rotating blades against walls of the cylindrical block, negatively affecting an efficiency and a durability of such machines, particularly at higher speeds.

Since 1927 is known a Pneumaphore type blade compressor, working on a principle of oil injection into a compressed air, permitting a partial reduction of energy losses and a blade wear. Similar purposes had a construction of compressors featuring blades made of light aluminium and, since 1964, even lighter plastics. Blade compressors of such design exclude, however, application of high speeds, limitation being in considerably lower strength of the blades.

U.S. Pat. No. 5,379,736 discloses a combustion engine consisting of an air compressor, a similarly designed exhaust gas decompressor and a combustion chamber positioned between the compressor and the decompressor. The compressor is provided with two rotating cylinders: an outer cylinder and an inner cylinder, respectively, interconnected and fixed on a common driveshaft, eccentric both in relation to the driveshaft's axis and between themselves. Between the rotating cylinders is situated a stationary intermediate unit provided with blades, swivelling on pivots fitted around an axis of the unit, wherein the blades during rotation of the eccentric cylinders take positions forming, between neighbouring blades and surfaces of the cylinders, chambers with periodically variable volume. A movement of the blades is forced by planetary gears, connecting the driveshaft with the pivots, being axes for the blades' rotation. Furthermore, the intermediate unit is provided with inlet and outlet flanges with valves, controlled by cams fixed on the driveshaft. The blades are rotating in the same direction as the driveshaft, but at half of the driveshafts' angular speed. Such design reduces considerably the expenditure of energy to overcome friction, but a certain energy is consumed to overcome inertia moments of the numerous moving parts of the machine.

German Patent DE 1 551 101 describes a rotary combustion engine, featuring oscillating working elements, set on pivots in a rotating ring and controlled by specially shaped two- or four-lobe cams, located on both sides of the ring. Working elements have, in a section, a shape of triangles with convex sides, the tops of which slide on surfaces of both cams, forming working chambers with periodically variable volume, causing intake and compression of a medium. During a rotation of the driveshaft, each oscillating working element is pressed by a centrifugal force against an inner surface of one cam, and at the same time tightened in relation to the central cam's outer surface by means of sealing strips, pressed against it.

A disadvantage of such engine, prevailing in other rotary engines, is in considerable energy losses, due to friction of numerous working elements against surfaces of cams, and in a difficulty of sealing the extremities of working elements in relation to the cams' working surfaces.

Polish Patent PL 109 449 and its German equivalent DE 1526408 disclose a rotary combustion engine, featuring an elliptic cylinder, inside which is moving a system of five pistons, connected by joints to create a closed chain, while between inner concave surfaces of the pistons and the elliptic surface of the cylinder, working chambers with periodically variable volume are formed. Pistons, being approximately triangular in section, are interconnected by sealed setting pins, placed in recesses in neighbouring pistons and provided with sealing strips, pressed against the elliptic surface of the engine's cylinder. A movement of the pistons is controlled by two rotors or discs, formed by joint-connected five segments with axes constituting extensions of axes of setting pins, located on both sides of the engine and transmitting torque to the engine's driveshaft.

A disadvantage of such construction, and other similar designs of working machines, in which kinematically connected working elements form a closed chain, is in a presence of variable moments of inertia, increasing friction losses, and thus reducing efficiency of the machines.

International Patent Application WO 00/42290 describes a rotary combustion engine, consisting of an engine block and of a rotor, located inside it and featuring four movable pistons, in the form of double-arm levers, oscillating around axes parallel to a central axis of the block and at the same time revolving together with the rotor. The pistons are provided with thrust rolls, which during movement along a circumference of the engine block, are driven by a system of cams, consisting of an outer cam and an inner cam. Mating of the thrust elements of the pistons with cam surfaces forces, during the common rotation, oscillating of the pistons around semicircular projections on the rotor. The pistons are sealed against each other by means of toothed contact surfaces, while between their working surfaces and an inner cylindrical surface of the engine block are formed chambers with periodically variable volume, enabling intake and compression of a medium.

A disadvantage of such design is in considerable friction forces, generated between the concave surface of pistons and the semicircular projections on the rotor, in connection with important mutual pressures between mating surfaces. Considerable frictional losses arise also on the thrust elements of pistons, driven in a slot between the two cams.

It is an object of the invention to provide a rotary working machine, provided with an assembly of variable volume working chambers, in particular a compressor, which provides a considerable reduction of losses, caused by friction, and thus, accordingly improves efficiency of the machine.

Research work, which led to the invention, has proven that it is possible to considerably limit the energetic losses, which result in known rotary machines of forces acting on individual components of these, by such a correlation of kinematic connection system of the working elements with distribution of their masses, as to reduce, for any rotation speed of the machine, movements of the working elements to resonance oscillations in the field of centrifugal force. The resonance character of the working elements' oscillations enables maintaining the motion by solely overcoming a minor resistance of the working elements replacement in relation to the rotor.

The invention provides a rotary working machine provided with an assembly of working chambers with periodically variable volume, in particular a compressor, being characterized in that in that the assembly of working elements, forming a working unit, or separate working elements, are connected with the cylindrical rotator in a way enabling their oscillating motion, while points of contact of the working elements are simultaneously driven by a cam. Outline of the cam constitutes a line equidistant from a Radziwill curve, being a locus of points constituting a closed trajectory described, on an immobile plane perpendicular to the axis of the cylindrical rotator, by a vertex point of a working element, moving in relation to the rotator in an oscillation at a resonance frequency during one full revolution of the cylindrical rotator. Inertia moment $I_{O1}$ of the working unit, or the working element, has a value ensuring a resonance frequency of proper vibration of the working unit, or working element, wherein a ratio of the frequency of resonance vibrations to a frequency of rotating motion of the cylindrical rotator is expressed by a natural number v.

In a preferred embodiment, the working element of the compressor is shaped as a blade with a section of concave-convex lens and is connected with a pivot, swivel mounted in the cylindrical rotator, while the compressor's working unit consists of at least two working elements, symmetrically located in relation to the pivot.

Preferably, the working unit consists of three working elements, while the middle working element constitutes a blade with a width twice larger than that of border blades and is equally distant from them, wherein pivots of the working unit are swivel mounted in rolling bearings, fitted in sockets in the cylindrical rotator, symmetrically on both sides of the middle blade and at the same distance from its axis of rotation, while the cams, mating with the working elements, are mounted on a common camshaft, while the middle cam is twice wider than the border cams, and each of the working elements has a vertex point surrounded by a cylindrical surface, constituting a set of points of contact with the corresponding cam's surface.

Advantageously, the compressor's camshaft is made hollow, while its central aperture is used to introduce and evacuate a medium, being compressed, and is connected with working chambers formed inside the cylindrical rotator, by means of intake and outlet slots of the cams.

Inside the central aperture of the camshaft is preferably fitted a pipe, the interior of which forms an internal manifold, introducing a medium being compressed, through the intake slots of the cams, to the working chambers formed in the interior the cylindrical rotator, while a slot between an outer surface of the pipe and an inner surface of the camshaft's aperture is connected, by the outlet slots of the cams, with the working chambers formed in the interior of the cylindrical rotator.

Cylindrical rotator of the compressor is provided with at least five, preferably seven, symmetrically located around its axis of rotation, cylindrical apertures, in which are fitted rolling bearings with swivel mounted working units, and also it is provided on its inner surface with the same number of cylindrical recesses, coaxial in relation to axes of the apertures for bearings.

The compressor is advantageously provided with a stationary block, encasing the cylindrical rotator and being closed by an outside manifold, connected with the stationary camshaft and provided with an intake aperture, introducing a medium, being compressed, to the internal manifold, and with an outlet aperture, evacuating the compressed medium from the annular slot, wherein the cylindrical rotator is on its other extremity connected with a flange of a coupling, through which is transmitted a drive from a power source of the compressor.

In accordance with another embodiment of the invention, the compressor is provided with an assembly of working elements in the form of cradles, limited on one side by a cylindrical surface with a curvature radius equal to half of a curvature radius of an inner surface of the cylindrical rotator, and on the other side provided with a projection, a vertex point of which is surrounded by a cylindrical surface, constituting a set of points of contact with the cam's surface.

Preferably, the cylindrical rotator of the compressor is provided on its inner surface with radial projections, directed towards its interior, while lateral surfaces of the projections are convergent towards an axis of the cylindrical rotor.

The cylindrical rotator in this variation of the compressor has on its inner surface at least four, preferably eight radial projections.

Advantageously, the stationary cam of this variation of the compressor, having an outline corresponding to a line equidistant from a Radziwill curve, is provided with at least one, and preferably two transverse intake apertures, connected by intake slots of the cam with working chambers, formed in the interior of the cylindrical rotator, and with at least one, preferably two outlet apertures, connected by outlet slots of the cam with the working chambers formed in the interior of the cylindrical rotator.

Rotary working machine, in particular a compressor according to the invention, is characterized by a compactness of its design, expressed in that a ratio of total change of the chambers' volume (equivalent of a displacement volume) to a volume of inner outline of the machine's moving part is close to one. Furthermore, an implementation of the compressor has proven, that thanks to elimination of losses to overcome friction forces and motion resistance, prevailing in known similar machines, it achieves an efficiency in an order of 90%. It is important for the ratio of the working elements' resonance oscillation frequency to the frequency of the rotator's revolutions to remain, in the conditions of steady movement, constant for all speeds of the rotator. This means that the machine is characterized by a high efficiency independent on the rotator's rotational speed.

A rotary working machine according to the invention, provided with a system of working chambers with periodically variable volume, constituting a compressor, will now further be explained with reference to exemplary embodiments in the accompanying drawings, in which.

Figure 1:
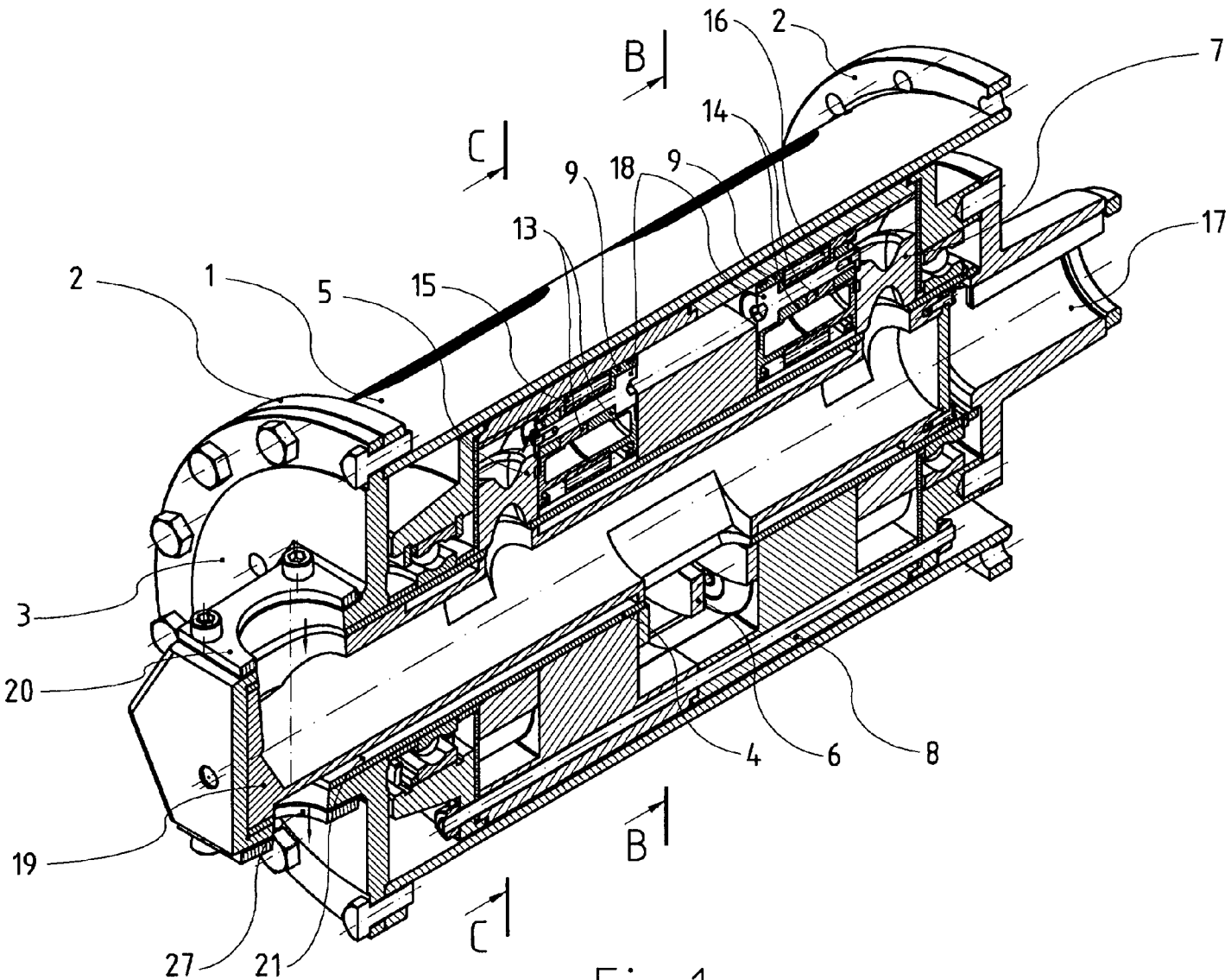
FIG. 1 is a perspective and sectional view of a compressor provided with three sets of working chambers, each one of which has seven blade-shaped working elements.
Figure 8:
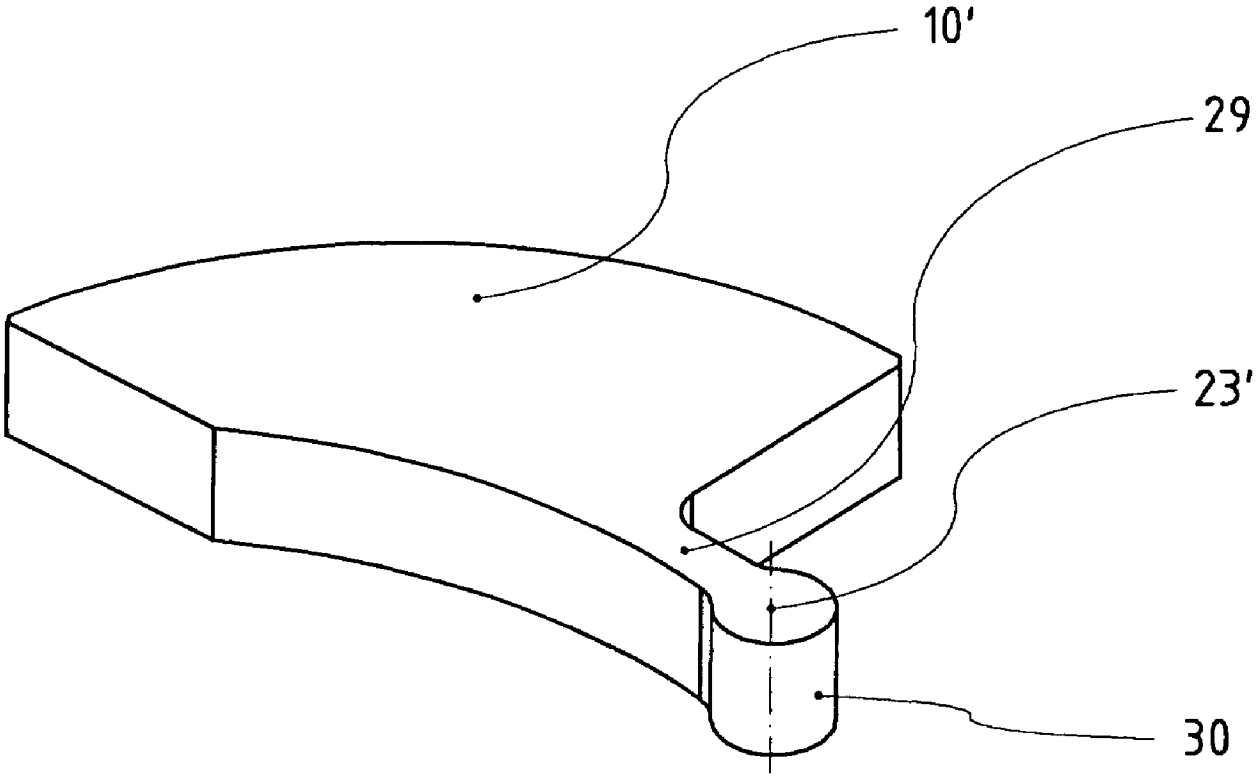
Figure 9:
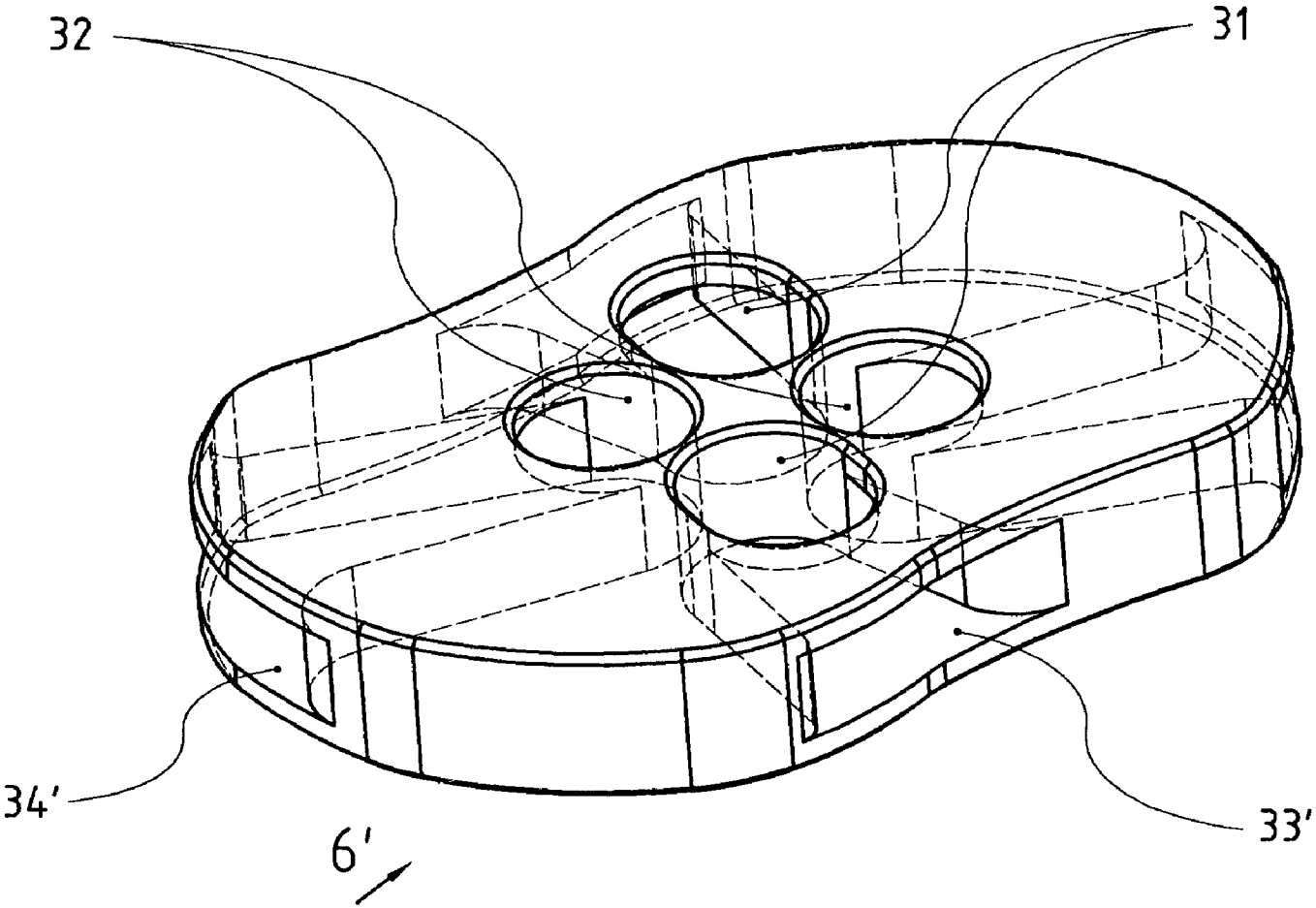

FIGS. 7*a*, 7*b*, 7*c* and 7*d* are sectional views of the compressor of FIG. 1: a) in a position of suction in a chamber A, b) in a position of compression in the chamber A c) in a position of isobaric pressout from the chamber A, and d) in a position of decompression in the chamber A;

FIG. 8 is a perspective view of a cradle-shaped working unit of another embodiment of the compressor according to the invention;

FIG. 9 is a perspective view of another embodiment of a cam according to the invention, the outline of which corresponds to a Radziwi*ll* curve adapted to oscillation of cradle-shaped working units, and FIGS. 10*a*, 10*b*, 10*c* and 10*d* are sectional views of the compressor featuring the cradle-shaped working units and the cam of FIG. 9: a) in a position of suction in the chambers B, b) in a position of compression in the chambers B, c) in a position of pressout from the chambers B, and d) in a position of decompression in the chambers B.

Figure 3:
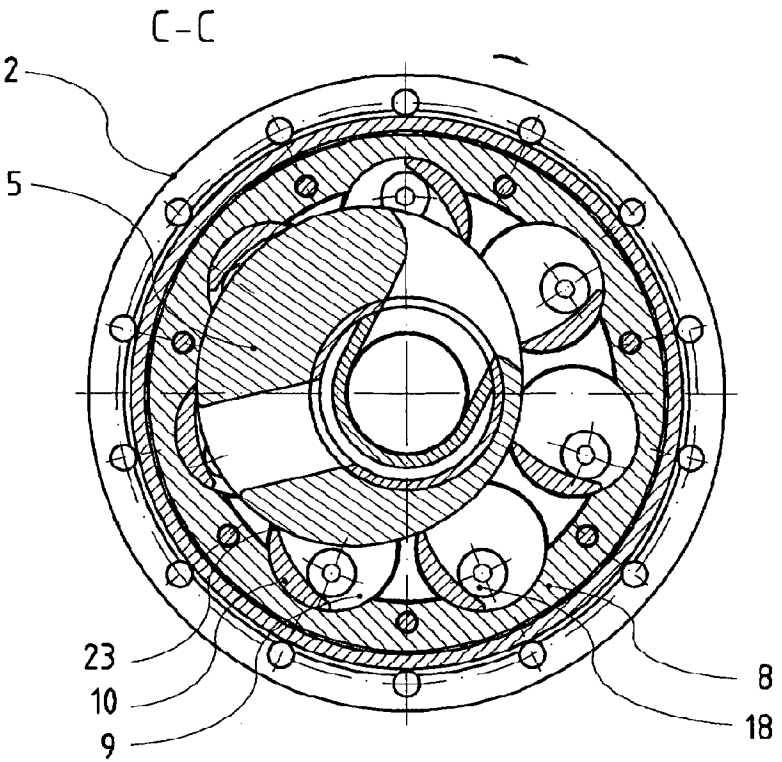
FIG. 3 is a sectional view of the compressor taken on the line B-B of FIG. 1.
Figure 2:
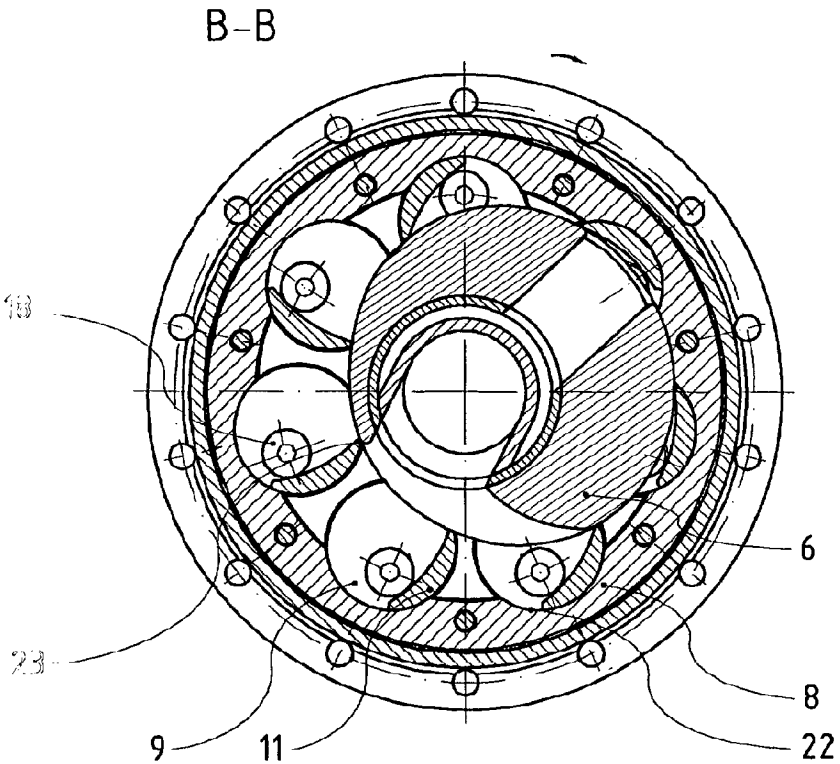
FIG. 2 is a sectional view of the compressor taken on the line A-A of FIG. 1.

As can be seen in FIGS. 1, 2 and 3, the rotary compressor according to the invention, provided with three sets of working chambers, consists of following principal components: a stationary block 1 in the form of a cylinder with flanges 2, closed on one side by an outside manifold, or stator 3, a stationary camshaft 4 fixed to the outside manifold 3 and having attached three cams 5, 6, and 7, a cylindrical rotator 8 surrounding the camshaft 4, and seven identical working units 9, each featuring three blade-shaped working elements 10, 11, 12—set in the cylindrical rotator 8, on bearings around its axis.

The cylindrical rotator 8 is connected on the other side, opposite to the outside manifold 3, with a flange of a coupling 20, transmitting the compressor's drive from a power source (not shown in the drawings).

Working element 10, 11, 12 (FIGS. 2, 3 and 4) performs a function of lateral limitation of the working chambers with periodically variable volume, formed between the inner surface of the cylindrical rotator 8 and the surface of the cam 5, 6, 7, wherein in a majority of patent descriptions concerning rotary working machines, similar element is called a piston. As a function being performed by the working element according to the invention is somewhat different to that of a classic piston, in the present description it is called "working element".

The working element 10, 11, 12 has, in a section, a shape of concave-convex lens, while its rounded tip, constituting a set of points 23 of contact surrounding a vertex C, is driven by an outer surface of the cam 5, 6, or 7 (FIGS. 2 and 3).

Figure 4:
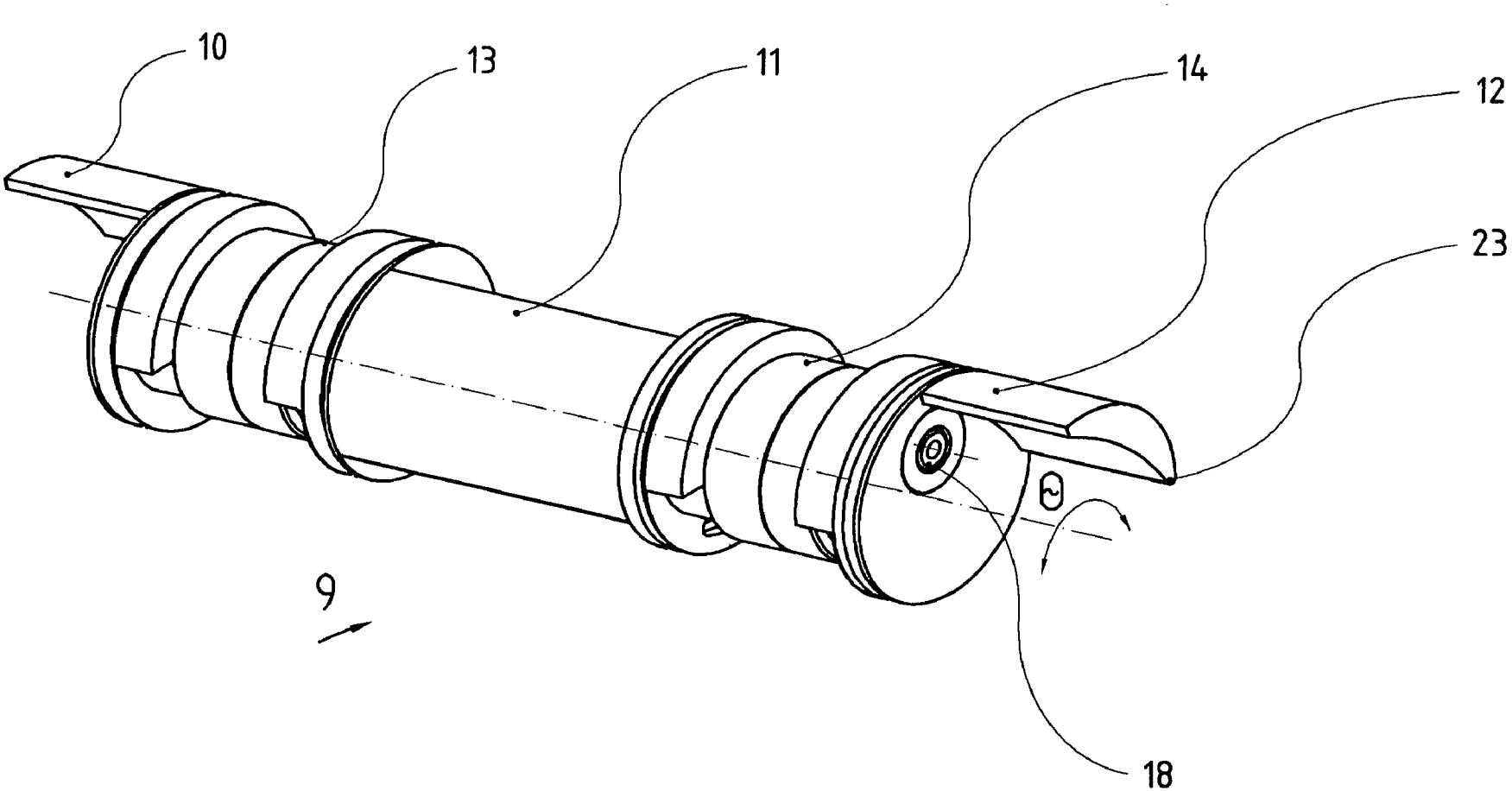
FIG. 4 is a perspective view of a working unit of the compressor shown in FIG. 1, in the form of a shaft provided with three blade-shaped working elements.

The working units 9 (FIG. 4) are provided with cylindrical pivots 13, 14, set in needle-type rolling bearings 15, 16 (FIG. 1), fitted in the cylindrical rotator 8 in such a way that axes of the individual working units form identical central angles around the axis 17 of the rotator 8, and a distance of the axes from the axis 17 of the rotator 8 is the same for all the working units 9 (FIGS. 2 and 3). Individual elements of the working unit 9, namely the blade-shaped working elements 10, 11, 12 and the pivots 13, 14 are advantageously connected by means of screws 18 (FIG. 4).

Configuration of each of the working elements 9, particularly its shape and dimensions, density of materials used and a distance of the working unit's 9 axis from the axis 17 of the cylindrical rotator 8 should be so selected, that a ratio of the period of rotation of this rotator 8 to the period of resonance oscillation of the working unit 9 for a certain, determined amplitude of oscillation, would be expressed by a natural number close to one, for example 1,2 or 3.

This condition is fulfilled, when an inertia moment $l_{o1}$ of the working unit 9 in relation to the oscillation axis O1 satisfies an equation:

$$I_{O1} = \left[\frac{\pi}{2vK_{\left(\frac{\theta_0}{2}\right)}}\right]^2 \cdot \ell \cdot s \cdot m$$

where:

v is a natural number expressing a ratio of rotation period of the cylindrical rotator 8 to a resonance oscillation period of the working unit 9, v=1, 2, 3 . . . ;

l is a distance of the working unit's 9 oscillation axis from the cylindrical rotator's 8 rotation axis;

s is a distance of a mass centre of the working unit 9 from an oscillation axis of the working unit;

m is a working unit's mass;

$\theta_0$ is an angle corresponding to an amplitude of the working unit's oscillation in relation to the rotator; and $K_{(\theta_0/2)}$ is a tabulated elliptic complete integral of first kind corresponding to the oscillation amplitude $\theta_0$.

Figure 6:
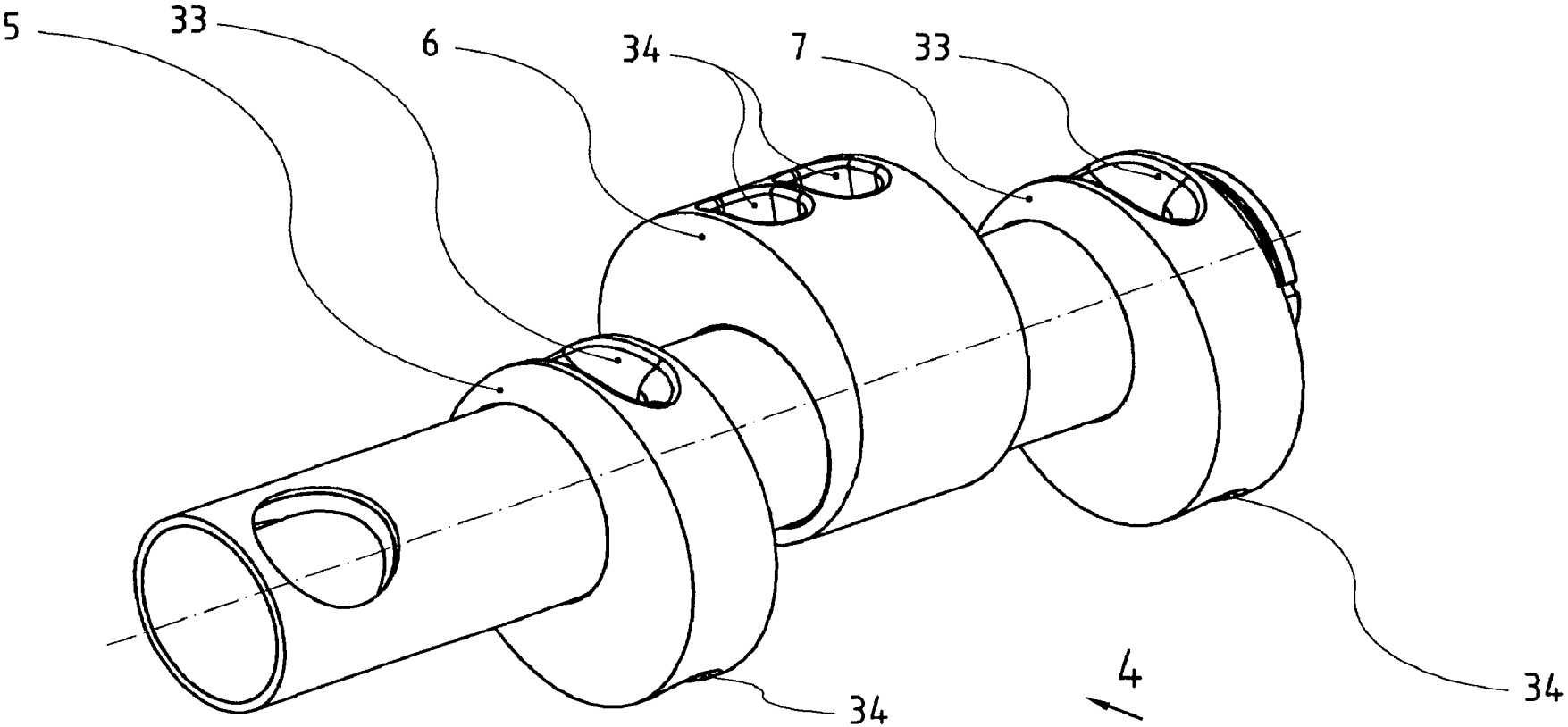
FIG. 6 is a perspective view of a stationary camshaft with three cams of the compressor of FIG. 1.

FIG. 6 shows a stationary camshaft 4 of a compressor according to the invention, provided with three cams 5, 6, and 7, and connected with an outside manifold 3. The camshaft 4 is provided with a pipe 19 (FIG. 1) fixed inside it, an interior of which form an internal manifold 25 for an intake of a medium being compressed. Between an outer surface of the pipe 19 and an inner surface of the camshaft's 4 axial aperture is situated an annular slot 21, evacuating the compressed medium from the compressor.

Individual cams 5, 6 and 7 set on the camshaft 4, are provided with intake apertures 33, perpendicular to the axis of the shaft and connected with the interior of the pipe 19 being connected with the intake aperture 26, and also with outlet apertures 34, situated on the opposite side of the cam and connected with an evacuation slot 21, the outlet aperture 27 of which is connected by a conduit with a vessel for the compressed medium (not shown in the drawing).

The cams 5, 6 and 7 have, in a section perpendicular to the axis of the stationary camshaft 4, a shape of curves equidistant from a Radziwi*ll* curve.

Figure 5:
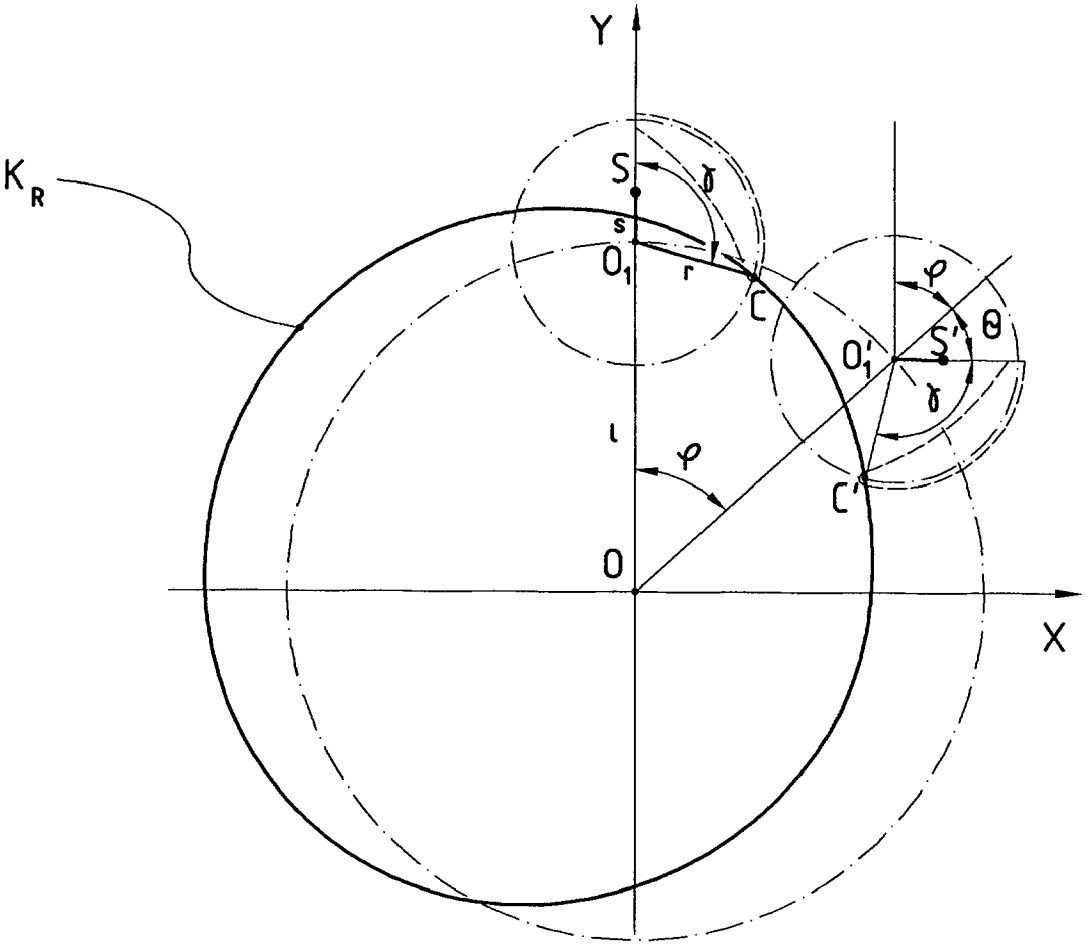
FIG. 5 is a Radziwi*ll* curve constituting a basis for an outline of a cam in the compressor of FIG. 1.

The Radziwi*ll* curve, shown in FIG. 5, is a locus of points constituting a closed trajectory described, on an immobile plane, by a vertex C of a working element 10, 11, 12 in an oscillation with a resonance frequency of the working unit's 9 motion, during one revolution of the cylindrical rotator 8.

The Radziwi*ll* curve is described by a set of parametric equations:

$$X(\phi)=l\cdot\sin\phi+r\cdot\sin(\phi+\gamma+\theta(\phi))$$

$$Y(\phi)=l\cdot\cos\phi+r\cdot\sin(\phi+\gamma+\theta(\phi))$$

where:

$\phi$ is a rotation angle of the rotator 8 from a position of minimum potential energy, that is from a position, in which points O, $O_1$, S are on a single straight line determining an axis OY in FIG. 5;

$X(\phi)$ denotes an abscissa of a position of a vertex C of each of the working elements 10, 11, 12 of the working unit 9 in a co-ordinate system having a centre in the point O being the cylindrical rotator's 8 axis of rotation, after its rotation through the angle $\phi$;

Y(ϕ) denotes an ordinate of a position of a vertex C of each of the working elements 10, 11, 12 of the working unit 9 in a co-ordinate system having a centre in the point O being the cylindrical rotator's 8 axis of rotation, after its rotation through the angle ϕ;

l is a distance ($OO_1$) of the working unit's 9 oscillation axis from the cylindrical rotator's 8 axis of rotation;

r is a distance of the vertex point C from the oscillation axis of the working unit 9 ($O_1C$);

Y is a constant angle formed between the axes $O_1S$ and $O_1C$, where S is a mass centre of the working unit 9;

θ(ϕ) is an angle by which the $O_1S$ axis deflects during the rotator's movement through the angle ϕ, wherein a relation between the rotation angle ϕ of the cylindrical rotator 8 and the deflexion angle θ of the axis $O_1S$ of each of the working elements 10, 11, 12 of the working unit 9 is expressed by an equation:

$$\theta(\varphi) = 2\arcsin\left(\sin\frac{\theta_0}{2}\sin\Psi(\varphi)\right)$$

where a relation between the angles ϕ and Ψ is described by tabulated values of elliptic integrals.

The above form of parametric equations describing the Radziwi*ll* curve relates to such a case of working element's 10, 11, 12 oscillation, in which the working unit's 9 oscillation axis is immovably bound with the cylindrical rotator 8. In a case of such design of a compressor, where the oscillation axis of the working element is variable, so that the working element oscillates by a cradle movement, in which the axis of oscillation is not immovably bound with the rotator 8', (see FIGS. 8 to 10), the equations describing the Radziwi*ll* curve must be accordingly modified.

A condition for closing the trajectory of the vertex point C of the working element 10, 11, 12, moving in relation to the cylindrical rotator 8 in an oscillating movement with a resonance frequency, is that a ratio of a period of full revolution of the cylindrical rotator 8 to the period of proper vibrations of the working unit 9 for a determined value of the oscillations' amplitude, is expressed by a natural number, preferably 1 or 2.

Since in the actual design of the compressor, the trajectory analysed on an immovable plane, perpendicular to the axis of the cylindrical rotator 8, relates not to the vertex point C of the working element 10, 11, 12 but to a set of points 23 of contact with the surface of the cam 5, 6, 7 and being equidistant from the vertex point C, also the external outline of the cams 5, 6, 7 constitutes a curve being equidistant from the Radziwi*ll* curve.

In a case, when the working unit 9 would be provided with a single working element, for example working element 10, while the camshaft would include only a single cam 5, additional movements of the working unit 9, interfering with its resonance oscillations, would be possible. To avoid such situation, it is advantageous that the working unit 9 is provided with at least two symmetric working elements 10 and 11, symmetrically located on a plane perpendicular to the axis of the cylindrical rotator 8, and driven by two, similarly symmetrical cams.

More preferred design include a working unit 9 shown in FIG. 4, consisting of two pairs of symmetrical working elements 10, 11 and 12, 11, while the middle working elements 11 are connected together to form a double working element 11. Thanks to this, inertia moments of the border working elements 10 and 12 are counterbalanced by an inertia moment of the middle working element 11, which eliminates torsion moments in the working unit 9, thus contributing to the compressor's steady operation.

In a construction of a compressor shown in FIG. 2, the cylindrical rotator 8 is provided with seven cylindrical apertures being symmetrically disposed around its internal outline and swivel mounted into which are working units 9, by means of needle bearings 15, 16. Furthermore, the rotator 8, in an area where working elements 10, 11, 12 of the working units are located, is provided with cylindrical recesses 22, coaxial in relation to the bearing apertures. The recesses 22 form sockets, in which the working elements 10, 11, 12 oscillate.

Because the working unit 9 is provided with an assembly of three working elements 10, 11, 12, in any time at least one of the working elements mates with a corresponding cam 5, 6, 7.

Operation of the compressor described above and shown schematically in a FIG. 7 is as follows.

Inside the cylindrical rotator 8 are formed three sets of working chambers, wherein each of the sets is controlled by one of the cams 5, 6, 7. In each of the sets exist seven working chambers, symmetrically located around the rotator's axis. Each working chamber is limited on the outside by an inner wall 24 of the cylindrical rotator 8 and, at least partly, by a cylindrical recess 22, on both sides by an inner and an outer surface of the mutually neighbouring working elements 10, 11, 12, respectively, and on the inside, by a lateral surface of the cam 5, 6 or 7. During a rotation of the cylindrical rotator 8 around its axis 17 consecutive periodical volume changes of the working chambers take place. Since the working chambers are symmetrical and identical in dimensions, changes of volume and functioning of one of the chambers A will be described hereafter (FIGS. 7*a*, 7*b*, 7*c* and 7*d*).

Figure 7B:
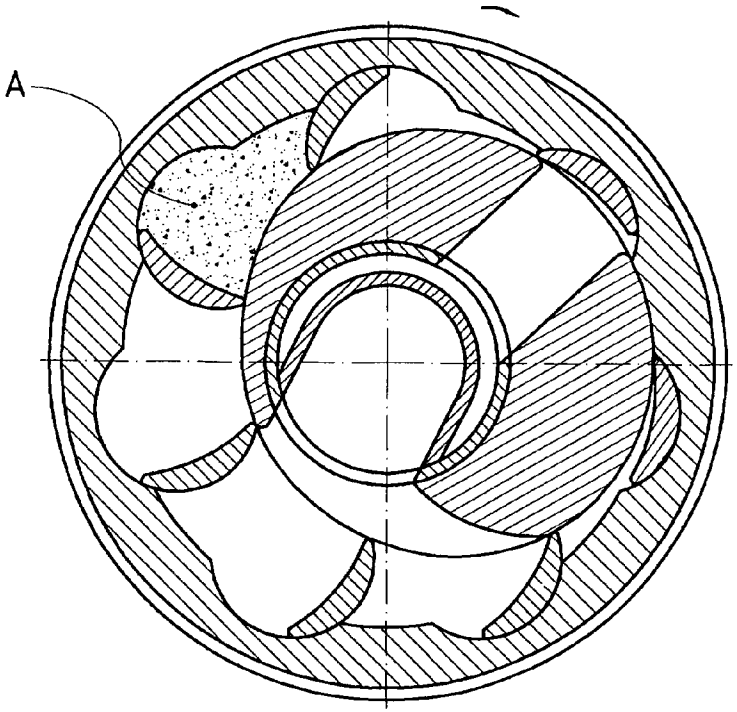
Figure 7A:
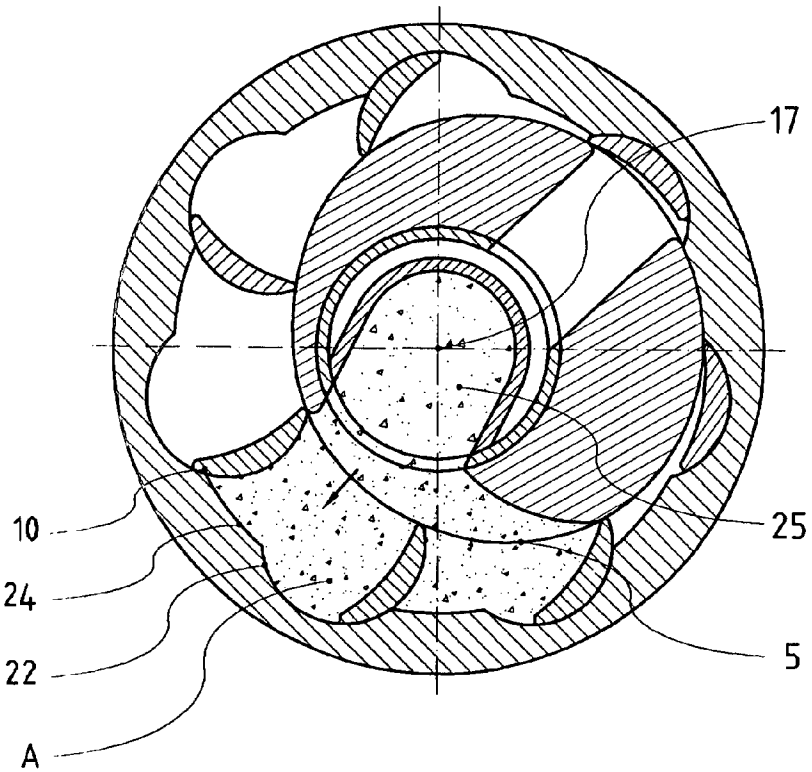

In a position shown in FIG. 7*a*, the working chamber A expands its volume and a resulting underpressure causes a suction of a medium being compressed, through an intake slot 33 of the cam 5, 6, 7, from the internal manifold 25 arranged inside the pipe 19 and connected with the intake aperture 26.

When the cylindrical rotator has covered approximately a quarter of full revolution to a position shown in FIG. 7*b*, the chamber A became completely closed, and its volume reduced in comparison to that position shown in FIG. 7*a*, implementing a compression cycle.

Figure 7D:
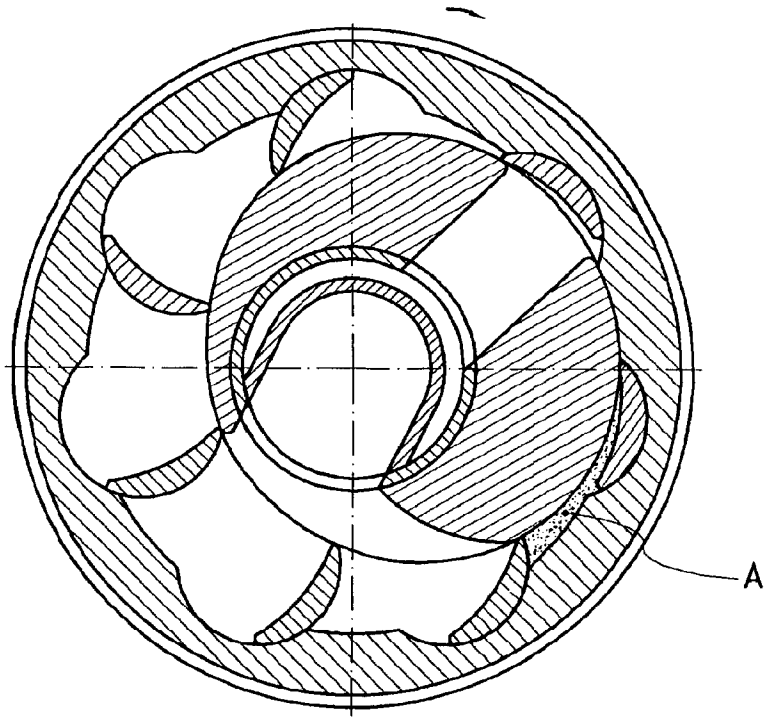
Figure 7C:
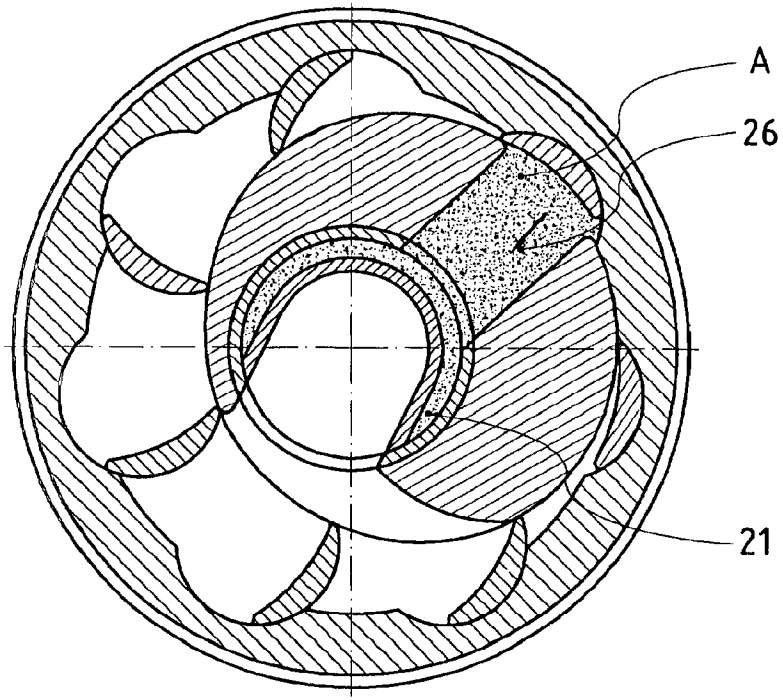

After consequent rotation of the cylindrical rotator by a next approximately ¼ of a turn to a position shown in FIG. 7*c*, the chamber A has achieved an almost minimal volume, and at the same time gained connection with an outlet slot 34, implementing a cycle of isobaric pressout, where the compressed medium passes through a slot 21 between an outer surface of the pipe 19 and an inner surface of an axial aperture of the camshaft 4 and is evacuated through the compressor's outlet aperture into a vessel (not shown in the drawing).

After next quarter turn of the cylindrical rotator to a position shown in FIG. 7*d*, the volume of the working chamber A has expanded in comparison to the position shown in FIG. 7*c*, therefore a cycle of decompression of the medium still remaining in the chamber A follows.

The rotator upon completion by of a next approximately ¼ of a turn takes the position shown in FIG. 7*a* and the compressor's working cycle repeats. Cumulative operation of the compressor is a sum of effects of individual chamber sets' functioning, similar to that of the chamber A presented above.

Due to an appropriate mass distribution of the working unit 9 and coincident driving of a set of points 23 of contact of the working elements 10, 11, 12 by the cam 5, 6, 7 with an outline equidistant from a Radziwi*ll* curve, a frequency of oscillations of the working unit 9 is equal to the rotator's revolution frequency (v =1), as a result of which the motion of individual working units 9 has a character of resonance oscillations in a centrifugal force field, supported by the cam. Thanks to this, considerable losses of energy prevailing in rotary machines known hitherto, have been eliminated.

FIG. 8 shows a working element 10' of another embodiment of the compressor according to the invention, having a shape of a cradle, swivel mounted in a socket of a cylindrical rotator 8', located between its inner surface 24' and inner, convergent to the centre, surfaces of two neighbouring radial projections 28 of the rotator 8'. Lateral surfaces of the projections 28 are (being radial) mutually convergent in a direction of an axis 17' of the rotator 8'.

An outline of the cradle of the working element 10' is a cylindrical surface 30, a radius of curvature of which is twice less than a radius of the rotator's 8' inner surface 24'.

A vertex point C' of the working element 10' is surrounded by a cylindrical surface constituting a set of points 23' of contact and forming a tip of a projection 29'. The set of points 23' of contact of the working element 10' mates with a surface of a cam 5', providing for the motion of the vertex point C' a trajectory being a Radziwi*ll* curve on a stationary plane. The Radziwill curve, constituting a line equidistant from an outline of the cam 5', is determined for this variation of the compressor by appropriately modified parametric equations.

The cam 5' is further provided with two intake apertures 31 and two outlet apertures 32, connected with slots 33 and 34, respectively, having outlets on a lateral surface of the cam 5' and destined to introduce and evacuate a medium, being compressed, into and out of the working chambers, formed inside the rotator 8'.

Operation of the compressor's variation, shown schematically in FIG. 10 is as follows:

Inside the cylindrical rotator 8' is created a single assembly of working chambers, controlled by the cam 5' and including eight chambers, symmetrically located around an axis of the cylindrical rotator 8'. Each working chamber is limited on the outside by an inner and outer surfaces of neighbouring working chambers 10' and by a part of outside surfaces of the radial projection 28, while on the inside by a lateral surface of the cam 5'. During the rotation of the cylindrical rotator around its axis 17', the working elements oscillate, the outer cylindrical surface of the cradle 30 rolling without a slip on the inner surface 24' of the cylindrical rotator 8', which causes consecutive periodic changes of the working chambers' volume.

Bearing in mind a symmetry and identical dimensions of the working chambers, volume changes of two identical chambers B (FIGS. 7*a*, 7*b*, 7*c*, 7*d*), symmetrically located in relation to the axis 17' on opposite sides of the cylindrical rotator 8' and functioning of the compressor, resulting of these changes, will now be described.

Figure 10B:
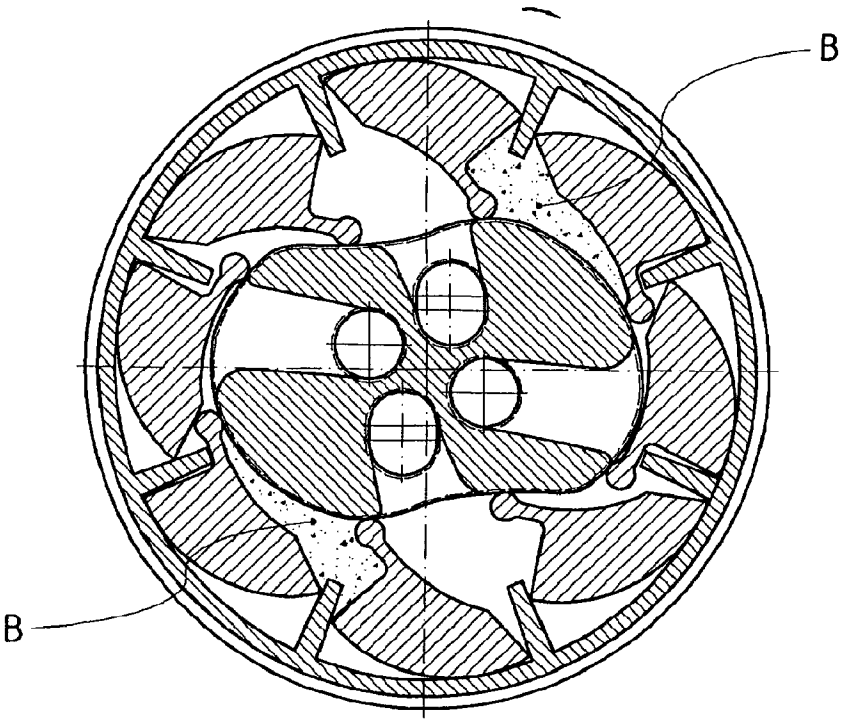
Figure 10A:
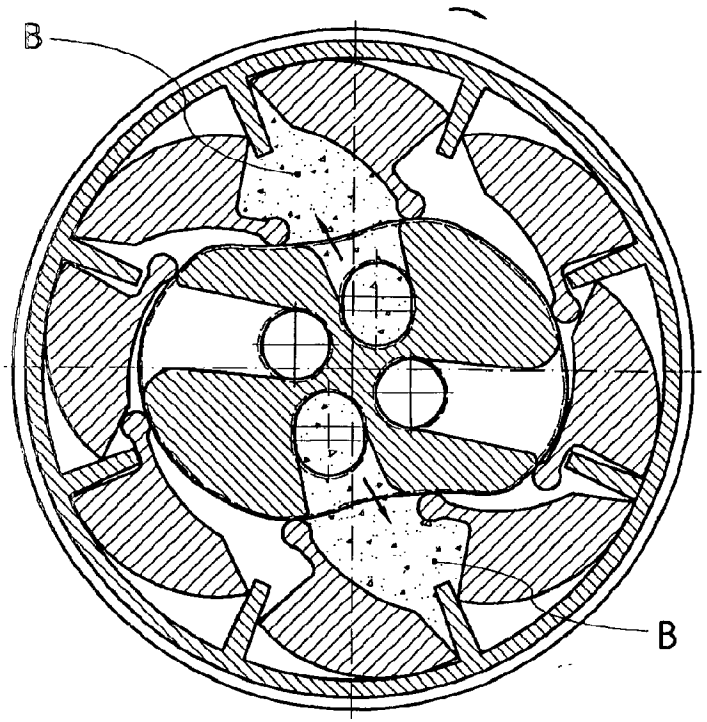

In a position shown in FIG. 10*a*, the working chamber B expands its volume, and a resulting underpressure causes suction of a medium, being compressed, through the slot 33' of the cam 5' and the intake aperture 31 connected with it.

When the cylindrical rotator has covered approximately ⅛ of a full revolution to a position shown in FIG. 10*b*, the working chamber B became completely closed and its volume reduced in comparison to that shown in FIG. 7*a*, a cycle of compression has taken place.

Figure 10D:
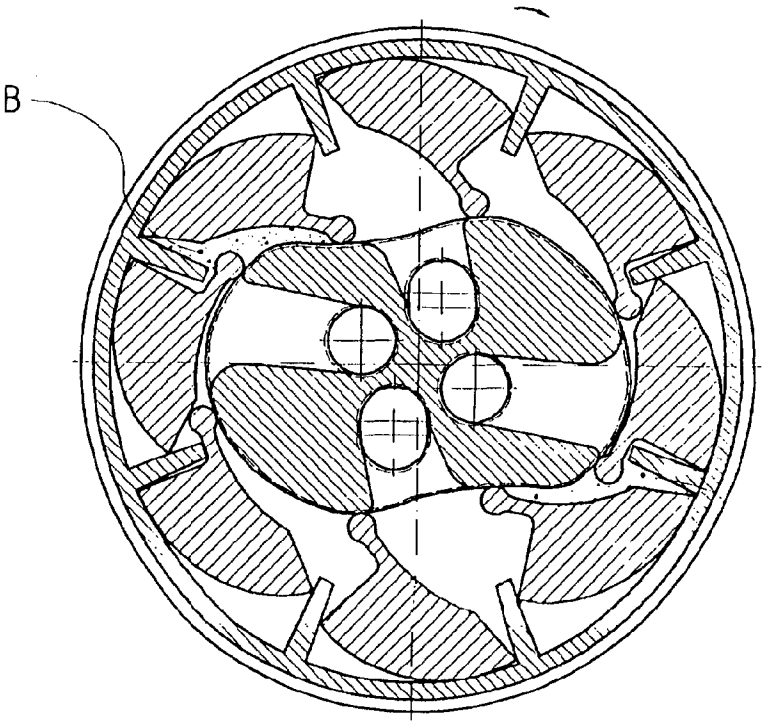
Figure 10C:
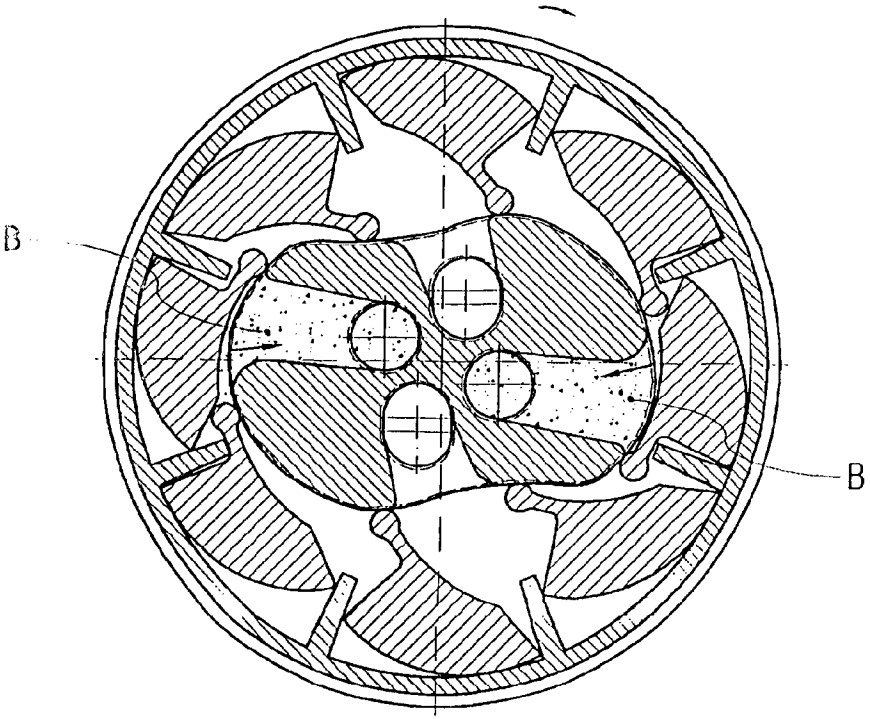

After a next turn of the rotator 8' by approximately ⅛ of a full revolution, to a position shown in FIG. 10*c*, the working chamber B, which has achieved a minimal volume and at the same time gained connection to the slot 34 of the cam 5' and to the outlet aperture 32, performs a cycle of isobaric pressout, in which the compressed medium is evacuated by the slot 34, the outlet aperture 32 and an attached conduit to a vessel (not shown in the drawing).

Upon covering by the rotator 8' of a next approximately ⅛ of a full revolution, to a position shown in the FIG. 10*d*, the working chamber B, has increased its volume in comparison to the position in FIG. 10*c*, as a result of which a cycle of decompression of remainders of the medium in the chamber takes place.

After a next ⅛ of a turn, the rotator assumes a position shown in FIG. 10*a*, in which the working chamber B increases its volume and the compressor's working cycle repeats. Cumulative operation of the compressor is a sum of its individual chambers functioning, similar to that of the chamber B in the example described above.

Due to an appropriate mass distribution of the working unit 10' and coincident driving of a set of points 23' of contact along the cam 5' with an outline equidistant from a Radziwi*ll* curve, a trajectory of vertex point C' corresponds to the Radziwi*ll* curve and a frequency of oscillations of the working unit 10' is equal to a half of the rotator's revolution frequency (v=2). Thanks to this, a motion of individual working units 10' in relation to the rotator is reduced to resonance oscillations in a centrifugal force field, supported by the cam 5', thus minimizing the considerable losses of energy prevailing in rotary machines known hitherto.

It will therefore be understood by those skilled in the art that the present invention is not limited to the embodiments shown and that many additions and modifications are possible without departing from the scope of the present invention as defined in the appending claims.

The invention claimed is:

1. A rotary working machine provided with an assembly of working chambers with periodically variable volume, comprising: a stator with at least one controlling cam located on an outer surface of the stator and a surrounding cylindrical rotator comprising a set of oscillating working elements provided within a plurality of cylindrical sockets on an inner surface of the cylindrical rotator to enable oscillatory motion of the set of oscillating working elements, wherein the set of oscillating working elements are driven by the controlling cam on a stator outer surface, wherein an inner surface of the cylindrical rotator and an outer surface of the controlling cam define a plurality of working chambers with a variable volume that are each connected during the rotation of the cylindrical rotator with an intake and an outlet for a medium being compressed, wherein the outline of the controlling cam constitutes a line equidistant from a curve comprising the range of the points XQp) and Y(p) which are described by the parametric equations:

$$X(\phi)=l\sin\phi+r\sin(\phi+y+\theta(\phi))$$

$$Y(\phi)=l\cos\phi+r\sin(\phi+y+\theta(\phi))$$

further comprising a locus of points forming a closed trajectory on an immobile plane perpendicular to the axis of the cylindrical rotator, by the vertex point of the working elements moving in relation to the rotator in an oscillation with a resonance frequency during one full revolution of the cylindrical rotator, wherein an inertia moment of the working elements are provided in parallel to an oscillation axis to obtain a resonance frequency of proper vibration of the set of oscillating working elements in relation to the cylindrical rotator as expressed by the following equation:

$$I_{O1} = \left[\frac{\pi}{2vK_{\left(\frac{\theta_0}{2}\right)}}\right]^2 \cdot \ell \cdot s \cdot m$$

wherein a ratio of the resonance oscillation frequency to a frequency of rotation of the cylindrical rotator is expressed by a constant natural number.

2. The machine according to claim 1, wherein each of said working elements is blade-shaped with a concave-convex section and is connected with a pivot that is swivel mounted in the cylindrical rotator.

3. The machine according to claim 2, wherein at least two working elements in the set of oscillating working elements are parallel and symmetrically located in relation to the pivot.

4. The machine according to claim 3 wherein the at least two working elements in the set of working elements comprise a working unit that includes a middle first oscillating working element comprising a blade with a width twice as large as a width of blades of second and third oscillating working elements of the working unit, wherein the second and third oscillating working elements are disposed outboard of the first oscillating working element blades and the first, second, and third oscillating working elements are located in equal distance from the remaining oscillating working elements, wherein the pivots of the working unit are swivel mounted in rolling bearings provided in sockets of the cylindrical rotator symmetrically on opposite sides of the first oscillating working element and in an equal distance from an axis of rotation, wherein the controlling cam mates with the working elements provided on the stator that form a camshaft, wherein the at least one controlling cam comprises a first controlling cam, a second controlling cam, and a third controlling cam; wherein the first controlling cam is twice as wide as the second and third controlling cams of the at least one controlling cam, and each of the oscillating working elements has a vertex point comprising a contact edge for engagement with a surface of the corresponding controlling cam.

5. The machine according to claim 4, wherein the camshaft is hollow with a central aperture for introduction and evacuation of a compressible medium with respective working chambers formed inside the cylindrical rotator in communication with a plurality of intake slots and outlet slots of the controlling cams.

6. The machine according to claim 4 further comprising an axial aperture in the camshaft that receives a pipe forming an internal manifold for introducing a medium to be compressed, wherein the pipe further comprises a plurality of intake slots in communication with the working chambers formed in the interior of the cylindrical rotator, wherein a slot between an outer surface of the pipe and an inner surface of the aperture in the camshaft is connected with a plurality of outlet slots of the cams and a plurality of working chambers are formed in the interior of the cylindrical rotator.

7. The machine according to claim 4, wherein the cylindrical rotator comprises at least five cylindrical apertures symmetrically located around the rotation axis of the cylindrical rotator, the cylindrical apertures housing rolling bearings with swivel mounted working units, and wherein the cylindrical rotator further comprises cylindrical sockets in which the working elements oscillate that are defined in an inner surface of the cylindrical rotator that are coaxial in relation to axes of the apertures for bearings.

8. The machine according to claim 2 further comprising a stationary block surrounding the cylindrical rotator and enclosed by an the stator the stationary block being connected with the stationary camshaft and provided with an intake aperture for introducing a medium to be compressed to the internal manifold, and further comprising an outlet aperture for evacuating a compressed medium from the annular slot, wherein the cylindrical rotator is connected with a flange of a coupling to transmit a drive from a power source.

9. The machine according to claim 1 further comprising an assembly of oscillating working elements in a form of cradles with a first cylindrical surface with a radius of curvature equal to half of a radius of curvature of an inner surface of the cylindrical rotator, wherein an opposite side of each oscillating working element comprises a projection and contact edge vertex point that is surrounded by a cylindrical surface, for engagement with the surface of the controlling cam.

10. The machine according to claim 9 wherein the cylindrical rotator further comprises radial projections that are directed towards the interior of the cylindrical rotator that are provided on the inner surface, while lateral surfaces of the projections are convergent towards an axis of the cylindrical rotator.

11. The machine according to claim 9 wherein the cylindrical rotator further comprises at least four radial projections provided on the inner surface of the cylindrical rotator.

12. The machine according to claim 9 wherein the cylindrical rotator further comprises at least eight radial projections provided on the inner surface of the cylindrical rotator.

13. The machine according to claim 9 wherein the controlling cam comprises an outline corresponding to a line equidistant from the curve and further comprises at least one transverse intake aperture that is in communication with the working chambers by intake slots of the controlling cam with the working chambers that are formed in the interior of the cylindrical rotator, and wherein the at least one transverse intake aperture is additionally in communication with at least one outlet aperture by outlet slots of the controlling cam.

* * * * *

UNITED STATES PATENT AND TRADEMARK OFFICE

CERTIFICATE OF CORRECTION

PATENT NO. : 7,458,791 B2
APPLICATION NO. : 10/592455
DATED : December 2, 2008
INVENTOR(S) : Maciej Radziwill It is certified that error appears in the above-identified patent and that said Letters Patent is hereby corrected as shown below:

In column 10, claim 1, line 53, after "of the points" delete "XQp)" and substitute --X(φ)-- in its place; and before "which are described" delete "Y(p)" and substitute --Y(φ)-- in its place.

In column 10, claim 1, lines 56, delete "$X(\phi)=l \sin \phi+r \sin(\phi+y+\theta(\phi))$" and substitute --$X(\varphi)=l \sin\varphi + r \sin(\varphi+\gamma+\theta(\varphi))$-- in its place.

In column 10, claim 1, lines 57, delete "$Y(\phi)=l \cos \phi+r \sin(\phi+y+\theta(\phi))$" and substitute --$Y(\varphi)=l \cos \varphi+r \sin(\varphi+\gamma+\theta(\varphi))$-- in its place.

In column 11, claim 4, lines 39-40, immediately after "second and third controlling cams" insert --,-- and delete "of the at least one controlling cam,".

In column 11, claim 5, line 48, after "and outlet slots of" insert --each of--.

In column 12, claim 8, line 17, after "enclosed by" delete "an the stator the" and substitute --the stator, the-- in its place.

Signed and Sealed this

Twenty-first Day of July, 2009

John Doll

JOHN DOLL
*Acting Director of the United States Patent and Trademark Office*